US010514661B2

(12) United States Patent
Dubos et al.

(10) Patent No.: US 10,514,661 B2
(45) **Date of Patent: *Dec. 24, 2019**

(54) TIMEPIECE MADE FROM ROSE GOLD ALLOY

(71) Applicant: ROLEX SA, Geneva (CH)

(72) Inventors: Pascal Dubos, Saint-George (CH); Jean-François Ricard, Saint Julien-en-Genevois (FR)

(73) Assignee: ROLEX SA, Geneva (CH)

( * ) Notice: Subject to any disclaimer, the term of this patent is extended or adjusted under 35 U.S.C. 154(b) by 314 days.

This patent is subject to a terminal disclaimer.

(21) Appl. No.: 14/765,630

(22) PCT Filed: Feb. 6, 2014

(86) PCT No.: PCT/EP2014/052372

§ 371 (c)(1),
(2) Date: Aug. 4, 2015

(87) PCT Pub. No.: WO2014/122234

PCT Pub. Date: Aug. 14, 2014

(65) Prior Publication Data

US 2015/0378311 A1 Dec. 31, 2015
US 2016/0306327 A2 Oct. 20, 2016

(30) Foreign Application Priority Data

Feb. 6, 2013 (EP) ..... 13154296
Feb. 13, 2013 (EP) ..... 13155142
Jan. 10, 2014 (EP) ..... 14150827

(51) Int. Cl.
*C22C 5/02* (2006.01)
*G04B 37/22* (2006.01)
*A44C 27/00* (2006.01)

(52) U.S. Cl.
CPC ..... *G04B 37/22* (2013.01); *A44C 27/003* (2013.01); *C22C 5/02* (2013.01)

(58) Field of Classification Search
CPC ..... C22C 5/02
See application file for complete search history.

(56) References Cited

U.S. PATENT DOCUMENTS

| | | | |
|---|---|---|---|
| 3,769,006 | A | 10/1973 | Ingersoll |
| 3,861,455 | A | 1/1975 | Ingersoll |
| 5,221,207 | A | 6/1993 | Schoeck et al. |
| 6,342,182 | B1 | 1/2002 | Vincent |
| 7,311,876 | B2 | 12/2007 | Baur et al. |
| 2005/0053514 | A1 | 3/2005 | Baur et al. |

FOREIGN PATENT DOCUMENTS

| | | | |
|---|---|---|---|
| CN | 1605645 | A | 4/2005 |
| CN | 100344780 | C | 10/2007 |
| DE | 19753055 | A1 | 6/1999 |
| DE | 19958800 | A1 | 1/2001 |
| EP | 2 135 972 | A1 | 12/2009 |
| GB | 2091294 | A | 7/1982 |
| JP | S48-084031 | A | 11/1973 |
| JP | H01-132728 | A | 5/1989 |
| JP | 2525527 | B2 | 8/1996 |
| JP | 11-335755 | A | 12/1999 |
| JP | 2008-308757 | A | 12/2008 |
| SU | 448239 | A1 | 10/1974 |
| WO | 2008/108181 | A1 | 6/2010 |

OTHER PUBLICATIONS

Pollero et al. Selection of gold alloys for mechanical working and optimisation of the production process. Jun. 2005. Jewelry Technology Forum. p. 215-239.*

Trueb, Lucien F. "Gold in watchmaking." Gold Bulletin 33.1 (2000): 11-24.*

International Search Report and Written Opinion dated May 28, 2014, issued in counterpart Int'l Appl. No. PCT/EP2014/052371 of related U.S. Appl. No. 14/765,648; w/English partial translation and partial machine translation (15 pages).

International Search Report and Written Opinion dated May 28, 2014, issued in counterpart Int'l Appl. No. PCT/EP2014/052372 of U.S. Appl. No. 14/765,630; w/English partial translation and partial machine translation (15 pages).

International Search Report and Written Opinion dated May 28, 2014, issued in counterpart Int'l Appl. No. PCT/EP2014/052373 of related U.S. Appl. No. 14/765,627; w/English partial translation and partial machine translation (18 pages).

Chinese Office Action dated Apr. 24, 2017 in counterpart Chinese application No. 201480007663.4 (with English machine translation; 16 pages).

Japanese Office Action dated Dec. 26, 2017 in Japanese application No. 2015-556502, counterpart of co-pending U.S. Appl. No. 14/765,627 (with English machine translation; 10 pages) (JP2008-308757, D2 cited in the Japanese Office Action is not listed in this IDS since it is listed in another IDS form filed concurrently).

Chinese Office Action date Jun. 1, 2017 in Chinese application No. 201480007708.8, counterpart of co-pending U.S. Appl. No. 14/765,648 (with English machine translation; 14 pages).

European Search Report and Written Opinion dated Sep. 4, 2013 in priority European application No. EP13155142 (with English machine translation; 16 pages) (SU448239, D2 and EP2134972, D3 cited in the European Search Report are not listed in this IDS since they were already listed in the IDS filed Aug. 14, 2015).

(Continued)

*Primary Examiner* — Jophy S. Koshy
(74) *Attorney, Agent, or Firm* — Westerman, Hattori, Daniels & Adrian, LLP

(57) ABSTRACT

A timepiece or piece of jewelry includes an alloy containing at least 750 wt.-‰ gold, characterized in that the alloy comprises at least 200‰ copper, 19‰-35‰ palladium and 1‰-16‰ indium. Optionally, the alloy may contain at least one grain refining element, and also optionally, the alloy may contain at least one element selected from the group consisting of Ca, Sr, Si, Zr, and Mg.

23 Claims, 4 Drawing Sheets

(56) References Cited

OTHER PUBLICATIONS

Chinese Office Action dated Aug. 2, 2016 in Chinese application No. 201480007708.8, counterpart of co-pending U.S. Appl. No. 14/765,648 (with English machine translation; 17 pages) (JPH11-335755, D1 cited in the Chinese Office Action is not listed in this IDS since it was already listed in the IDS filed Aug. 14, 2015).

Yuan Junping, "Study on the Technological Performance of 18K Rose Gold", Industrial Gold, vol. 32, No. 12, pp. 7-10, 2015 (with English machine translation; 19 pages; D3 cited in the Chinese Office Action dated Aug. 2, 2016).

Japanese Office Action dated Jan. 23, 2018 in Japanese application No. 2015-556500, counterpart of co-pending U.S. Appl. No. 14/765,648 (with English machine translation; 10 pages) (JPH11-335755A, D1 cited in the Japanese Office Action is not listed in this IDS since it was already listed in the IDS filed Aug. 14, 2015).

Japanese Office Action dated Jan. 23, 2018 in counterpart Japanese application No. 2015-556501 (with English achine translation; 9 pages) (JPH11-335755, D1 cited in the Japanese Office Action is not listed in this IDS since it was already listed in the IDS filed on Aug. 14, 2015; JP2008-308757, D2 and WO2008/108181, D3 are not listed in this IDS since they are listed in another IDS form filed concurrently).

Chinese Office Action dated Aug. 29, 2016 in Chinese application No. 201480007662.X, counterpart of co-pending U.S. Appl. No. 14/765,627 (with English machine translation; 12 pages) (JPH11-335755, D1 cited in the Chinese Office Action is not listed in this IDS since it was already listed in the IDS filed Aug. 4, 2015; Yinping, D2, and DE19958800, D3 are also not listed since they are listed in IDS form filed concurrently).

Chinese Office Action dated Aug. 1, 2017 in Chinese application No. 201480007662.X, counterpart of co-pending U.S. Appl. No. 14/765,627 (with English machine translation; 13 pages) (CN100344780 cited in the Chinese Office Action is not listed in this IDS since it is listed in an IDS filed concurrently).

Chinese Office Action dated Aug. 16, 2016 in counterpart Chinese application No. 201480007663.4 (with English machine translation; 12 pages) JPH11-335755, D1 cited in the Chinese Office Action is not listed in this IDS since it was already listed in the IDS filed Aug. 14, 2015; Yuan Yinping, D2 is not cited because it is listed in another IDS form filed concurrently).

* cited by examiner

| Alloy | ΔE after 20 days |
|---|---|
| 10Pd 5In 5Ca | 0.9 |
| 15Pd 10In 5Ca | 0.94 |
| 5Pd 10In 5Ca | 1.04 |
| 20Pd 10In | 1.14 |
| 10Pd 5In | 1.28 |
| 13Pd | 1.46 |
| 20In | 1.95 |
| 5In | 1.98 |
| 250Cu | 2.18 |

Fig. 3

| Alloy | ΔE after 40 days |
|---|---|
| 30Pd 2.5In | 0.99 |
| 25Pd 1In | 1.05 |
| 30Pd 15In | 1.05 |
| 30Pd | 1.2 |
| 25Pd 5In | 1.2 |
| 15In | 1.72 |
| 13Pd | 1.73 |
| 20In | 2.02 |
| 5In | 2.1 |
| 40Ag | 2.23 |
| 250Cu | 2.64 |

Fig. 4

| Alloy | ΔE after 40 days |
|---|---|
| 20Pd 10In 0.1Si | 0.91 |
| 20Pd 10In 1Ca | 0.96 |
| 10Pd 5In 5Ca | 1.05 |
| 20Pd 10In 0.5Ca | 1.07 |
| 20Pd 10In 0.02Si | 1.14 |
| 20Pd 10In | 1.23 |
| 10Pd 5In | 1.39 |
| 250Cu | 2.64 |

TIMEPIECE MADE FROM ROSE GOLD ALLOY

The invention relates to a rose gold alloy, particularly suitable for a timepiece, and a timepiece or jewelry part per se comprising such an alloy, for instance a watch.

PRIOR ART

The color of gold alloys depends on their contents of alloying elements. For 18 ct AuCuAg alloys for example, a copper content of greater than 180‰ and a silver content of the order of 40‰ gives them a red color. The color changes toward pink then toward yellow if the copper content decreases from 180‰ to 150‰ then from 150‰ to 60‰ and if the silver content increases from 40‰ to 150‰. We have observed that watch cases or bracelets manufactured from these standard gold alloys have a tendency to undergo a gradual modification of their color under the action of tap water, sea water, swimming pool water, salt water or else soapy water.

One of the objectives of the invention is to improve the resistance to color change of a timepiece or jewelry part manufactured from a rose gold alloy and subjected, during use, to weakly corrosive aqueous media.

Another objective of the invention is to define a gold alloy of pink color, the pink of which has the most attractive esthetic appearance possible.

BRIEF DESCRIPTION OF THE INVENTION

For this purpose, the invention is based on a timepiece or jewelry part comprising an alloy comprising at least 750‰ gold by weight, wherein the alloy comprises at least 200‰ copper, between 4‰ and 35‰ palladium and between 1‰ and 16‰ indium.

The invention is precisely defined by the claims.

BRIEF DESCRIPTION OF THE FIGURES

These subjects, features and advantages of the present invention will be explained in detail in the following description of particular embodiments given non-limitingly in connection with the appended figures, among which:

FIGS. 3 and 4 represent tables of discoloration test results obtained after 40 days on various alloys.

Figures 1, 2:
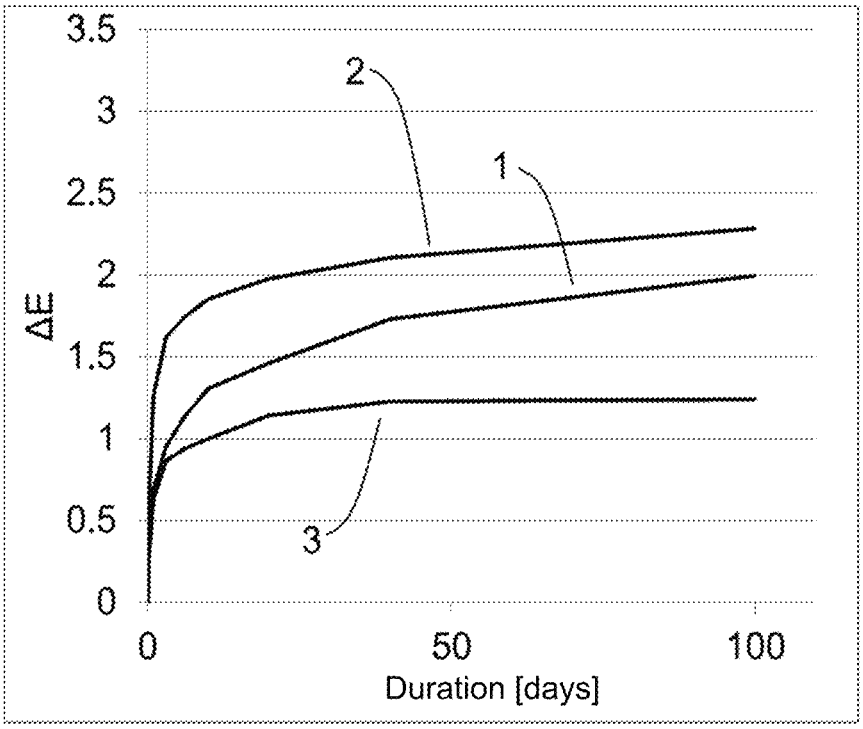
FIG. 1 shows three experimental discoloration curves obtained respectively on a 13 Pd (curve 1), 5 In (curve 2) and 20 Pd 10 In (curve 3) alloy.
FIG. 2 represents a table of discoloration test results obtained after 20 days on various alloys.

Embodiments of the invention will now be presented, using precise examples and results of empirical experiments. For this, ingots are prepared by static vacuum casting (melting in a graphite crucible and cooling under nitrogen). Samples are cut from the ingot in the as-cast state. The surface is prepared by polishing. A typical sample has a square cross section of 20 mm×20 mm×5 mm. All the tests are carried out on as-cast alloys, without subsequent deformation or heat treatment, and without addition of customary grain refiners.

Crystallographic analysis of the samples is carried out with an x-ray diffractometer with Cu anode. A metallographic test and an analysis of the stoichiometries of the phases are carried out by scanning electron microscopy SEM-EDX.

The color variations are measured with a spectrocolorimeter with integrating sphere. The color is defined conventionally by a point of the CIELAB space formed by a green-red axis as abscissa, by a blue-yellow axis as ordinate and from an axis representative of the contrast (cf. CIE15: 2004 report prepared by the International Commission on Illumination). The measurements were all carried out using the following convention: D65 illuminant and 10° standard observer (CIE1964). The color differences ΔE are defined by the DE2000 (equation 8.36, paragraph 8.3, CIE15:2004 report). The color difference is measured between new (cast and polished) samples and samples that have undergone accelerated aging in salt spray, with an exposure according to the NIHS 96-50 standard at a temperature of 45° C. with a saline solution containing 50 g/l of pure NaCl. The 750 Au 250 Cu alloy serves as a reference base.

The following convention is used for the naming of the alloys:

- for 18 ct (750 Au) alloys, indication of the content of the alloying elements in per mille by weight before the symbol of the element. The copper content is not indicated since it corresponds to the balance. However, this copper content will advantageously be greater than or equal to 180‰, or even greater than or equal to 200‰. Example: 10In corresponds to a 750 Au 240 Cu 10 In alloy;
- for alloys that are not 18 ct, indication of the content of Au in per mille by weight before the element then indication of the alloying elements in accordance with the preceding point;

The value ranges that will be mentioned hereinafter may include or exclude the limits thereof, and this will not always be specified.

The table in FIG. 2 and the graph of FIG. 1 summarize the results obtained after salt spray aging for various solid ingots made of gold alloy. The tables in FIGS. 3 and 4 present the results obtained on alloys after salt spray ageing for 40 days.

The 13 Pd alloy is very advantageous, from the point of view of the color obtained and of the discoloration. This discoloration as a function of time is represented by curve 1 from FIG. 1.

More generally, an alloy composed of at least 750‰ gold, of copper and with a content of palladium (Pd) defined by: Pd≤20‰ or Pd≤15‰, or 5‰≤Pd 15‰, or 8‰ Pd≤15‰, or 11‰≤Pd≤15‰, is advantageous.

The AuCuIn alloys are advantageous, since the results demonstrate that In makes it possible to form a single-phase alloy with Au and Cu. In particular, the 5 In alloy drifts very little, as is seen on curve 2 from FIG. 1, and already shows an improvement with respect to the reference of a 250 Cu alloy. Indeed, the tests carried out show that there is an optimum of the color drift between 5‰ and 20‰ In, in particular around 10‰, with a preferred range between 7‰≤In≤15‰. More generally, an alloy composed of at least 750‰ gold, of copper, and with a content of indium (In) defined by: In≤20‰ or In≤15‰, or 5‰≤In<20‰, or 7‰≤In≤15‰, is advantageous.

The quaternary or quinternary alloys comprising palladium are also very advantageous. In particular, as it emerges from the results from FIGS. 2 to 4 relating to the resistance to discoloration over time, the 20 Pd 10 In, 10 Pd 5 In 5 Ca, 15 Pd 10 In 5 Ca, 5 Pd 10 In 5 Ca, 10 Pd 5 In, 20 Pd 10 In 0.1 Si, 20 Pd 10 In 1 Ca, 20 Pd 10 In 0.5 Ca, 20 Pd 10 In 0.02 Si alloys exhibit low drifts and are advantageous. The AuCuPdIn alloys, such as, for example, the 20 Pd 10 In alloy or the 10 Pd 5 In alloy, are particularly advantageous.

More generally, an alloy composed of at least 750‰ gold, of copper, of palladium and of indium is advantageous, particularly when the sum of the contents of Pd and In is less than or equal to 45‰, or even 40‰, or even 35‰, or even 30‰, and/or when the sum of the contents of Pd and In is within the range between 15‰ and 40‰, or even between 20‰ and 35‰, and/or when the alloy comprises at least 1‰ Pd and 1‰ In, or even at least 5‰ Pd and 5‰ In.

More generally, an alloy composed of at least 750‰ gold, of copper, of palladium and of at least one element Y, Y being selected from Ca, Zr, or In, is advantageous, particularly when the sum of the contents of palladium and of the element(s) Y is less than or equal to 40‰, or even 35‰, or even 30‰, or even 25‰, or even 20‰, or even 17‰, or even 15‰, or even 13‰, and/or when the sum of the contents of Pd and of the element(s) Y is within the range between 15‰ and 40‰, or even between 20‰ and 35‰, and/or when the alloy comprises at least 1‰ Pd and 1‰ of the element(s) Y, or even at least 5‰ Pd and 5‰ of the element(s) Y.

More generally, an alloy composed of at least 750‰ gold, of copper, of palladium and of at least one element Y, Y being selected from In, Ca, Sr, Si, Ti, Zr, or Mg, is advantageous, particularly when the sum of the contents of palladium and of the element(s) Y is less than or equal to 40‰, or even 35‰, or even 30‰, or even 25‰, or even 20‰, or even 17‰, or even 15‰, or even 13‰, and/or when the sum of the contents of Pd and of the element(s) Y is within the range between 15‰ and 40‰, or even between 20‰ and 35‰, and/or when the alloy comprises at least 1‰ Pd and 1‰ of the element(s) Y, or even at least 5‰ Pd and 5‰ of the element(s) Y.

The quaternary or quinternary alloys with In are also advantageous. More generally, an alloy composed of at least 750‰ gold, of copper, of indium and of at least one element Y, Y being selected from Ca, Sr, Si, Ti, Zr, Mg or Pd, is advantageous, particularly when the sum of the contents of indium and of the element Y is less than or equal to 40‰, or even 35‰, or even 30‰, or even 25‰, or even 20‰, or even 17‰, or even 15‰, or even 13‰, and/or when the sum of the contents of In and of the element(s) Y is within the range between 15‰ and 40‰, or even between 20‰ and 35‰, and/or when the alloy comprises at least 1 Too In and 1 Too of the element(s) Y, or even at least 5‰ In and 5‰ of the element(s) Y.

The following ternary alloys that are 18 ct or more are particularly advantageous:

AuCuPd with Pd<20‰, more particularly with 5‰≤Pd<20‰, more particularly with 5‰≤Pd≤15‰.

AuCuIn with In<20‰, more particularly with 5‰≤In<20‰, more particularly with 7‰≤In≤15‰.

The AuCuPdIn quaternary alloys that are 18 ct or more are particularly advantageous:

in particular with the sum of the contents of Pd and In less than or equal to 45‰, or even 40‰, or even 35‰, or even 30‰;

and/or with the sum of the contents of Pd and In within the range between 15‰ and 40‰, or even between 20‰ and 35‰;

and/or with at least 1‰ Pd and 1‰ In, or even at least 5‰ Pd and 5‰ In;

in particular the 20 Pd 10 In alloy or the 10 Pd 5 In alloy.

The following quaternary or quinternary alloys that are 18 ct or more are also particularly advantageous:

AuCuXY, where X is Pd or In, and Y is at least one element from among Pd (if X≠Pd), In (if X≠In), Ca, Sr, Si, Ti, Zr, or Mg;

in particular with the sum of the contents X+Y≤40‰;

and/or with the concentrations for Pd, In and element(s) Y:Pd, In 40‰ and Y (Y≠In,Pd)≤10‰;

and/or with at least 1‰ Pd and 1‰ of the element(s) Y, or even at least 5‰ Pd and 5‰ of the element(s) Y.

The AuCuPdInX quinternary alloys where X is selected from Ca, Sr, Si, Ti, Zr, Mg are also advantageous.

Lastly, it should be noted that other alloys comprising more than four elements may also be advantageous, for example containing five or six elements, obtained by replacing the element Y from the quaternary compounds mentioned above with n elements $Y_1, Y_2, \ldots, Y_n$, the elements $Y_i$ preferably being selected from Ca, Sr, Si, Ti, Zr, Mg, Pd or In, and so that the sum of the contents of all the elements apart from Au and Cu is less than or equal to 40‰. Such alloys especially include the alloys comprising the components Au, Cu, Pd, In and X, where X is at least one element selected from Ca, Sr, Si, Ti, Zr, Mg.

Finally, it is noted that the alloys combining both palladium and indium are particularly advantageous compared to the alloys comprising only one or other of these components, as curve 3 from FIG. 1 and the results of the various tables from FIGS. 2 to 4 illustrate.

In particular, it appears that an alloy comprising at least 750‰ gold by weight, also comprising copper, palladium and indium, the sum of the contents of palladium and indium being less than or equal to 45‰, or even less than or equal to 35‰, or even less than or equal to 30‰, and/or the sum of the contents of palladium and indium being between 20‰ and 35‰, is advantageous. Such an alloy may comprise a content of indium defined by: 7‰≤content of In 15‰. Moreover, such an alloy may comprise gold, copper, palladium and calcium and/or silicon, so that the sum of the contents of all the elements apart from gold and copper is less than or equal to 40‰.

Figure 5:
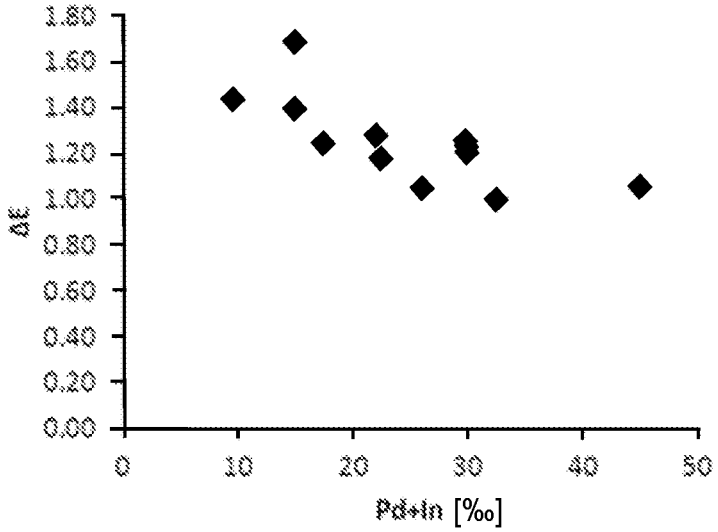
FIG. 5 represents the discoloration obtained after 40 days as a function of the sum of the palladium and indium components of various alloys.
Figure 6:
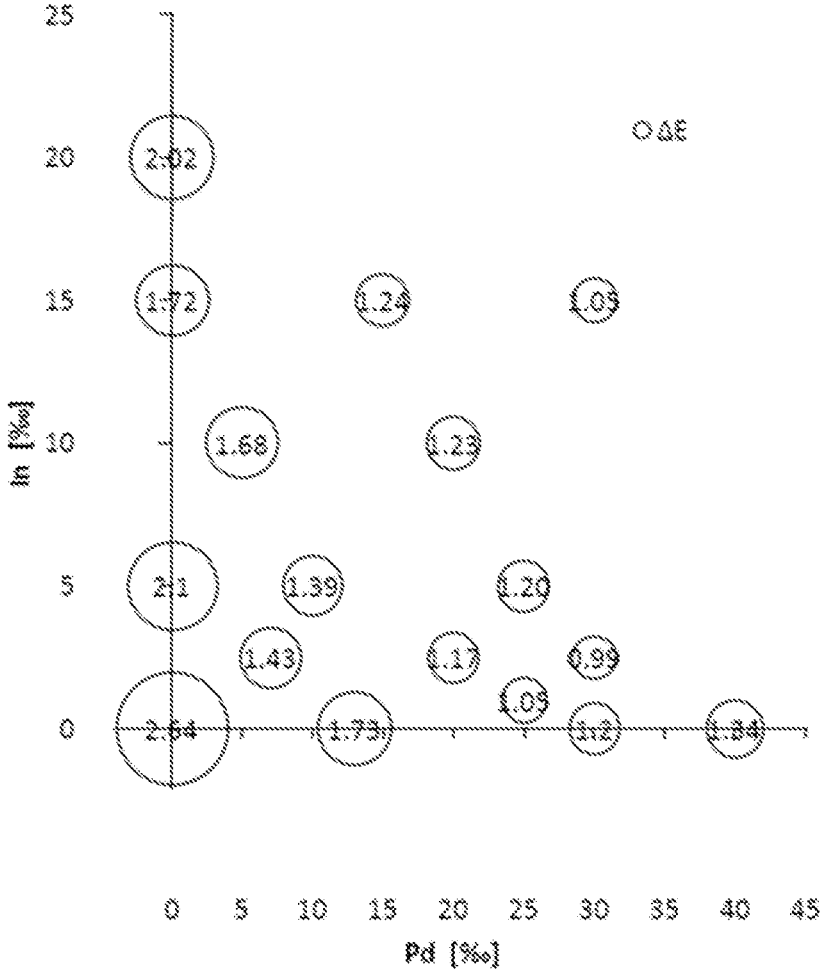
FIG. 6 illustrates the discoloration obtained after 40 days for various alloys as a function of the palladium and indium contents thereof.

FIGS. 5 and 6 additionally illustrate the advantage of combining palladium and indium and make it possible to visualize the optimal amounts.

FIG. 5 illustrates the discoloration obtained after 40 days for various alloys, as a function of the sum of the contents of palladium and indium that they comprise. It appears that the best results are obtained for a sum greater than or equal to 15‰, and are further improved for a sum greater than or equal to 20‰. The range 20‰-35‰ groups together several alloys that perform very well, and the reduced range 25‰-33‰ groups together results that are further optimized.

FIG. 6 gives additional information on the division of these contents between the two palladium and indium components. It appears that the best results are obtained for a palladium content between 15‰ and 30‰, or even between 19‰ and 29‰, and an indium content between 1‰ and 15‰ inclusive. As an observation, it is noted that, starting from the use of a small amount of indium, for example between 1‰ and 10‰, or between 1‰ and 6‰, and even between 1‰ and 4‰, there is a significant advantageous effect owing to the combination thereof with palladium.

Besides the above very important considerations relating to maintaining the color of an alloy over time, it is also necessary to take into account the quality of the color itself obtained for an alloy in question, and particularly the esthetics of the pink color obtained. Indeed, the addition of the various components mentioned above has an effect not only on maintaining the color over time, but also on the color itself of the alloy. For example, the addition of palladium to a rose gold alloy has the effect of desaturating the pink color, even of making the color of the alloy tend toward gray, and the addition of indium has the effect of a drift toward yellow of a rose alloy.

Figure 7:
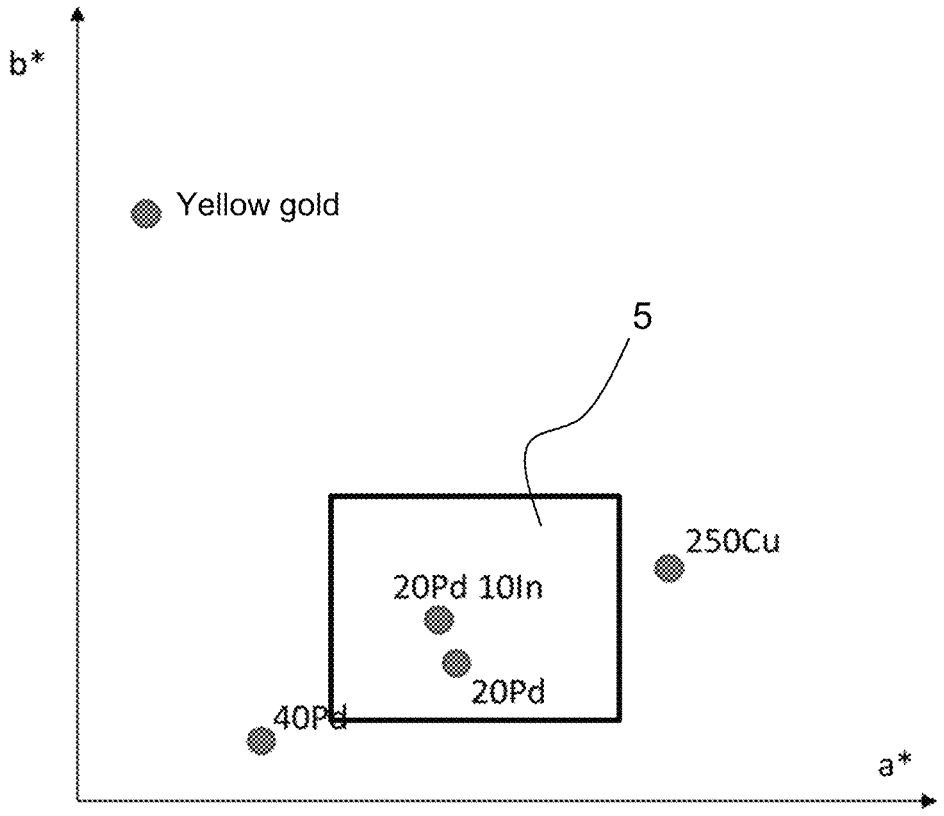
FIG. 7 schematically positions several alloys on a graph in order to illustrate the color obtained for these various alloys.

FIG. 7 schematically illustrates these observations. It is noted that the coordinate a* is the abscissa and the coordinate b* is the ordinate. As an observation, this color can be measured with respect to reference colors, and may also be the subject of a visual examination, the esthetic affect obtained being particularly notable via visual observation. The first reference alloy is a conventional 18 carat yellow gold alloy, positioned on the top left part of the diagram, in the vicinity of the ordinate axis, corresponding to a strong yellow dominant feature. The second reference alloy is a very red 18 carat gold alloy, comprising 250‰ copper, positioned on the bottom right part of the diagram, in the vicinity of the abscissa axis. It is noted that the addition of a relatively large amount of palladium, as the example of the 40 Pd alloy illustrates, has the effect of greatly reducing the saturation of the color, to ultimately give a very pale alloy, of grayish appearance. After several tests, it appears useful to use an amount of palladium less than or equal to 29‰ in order to retain a satisfactory pink color, which is expressed by a positioning in the zone 5 displayed in FIG. 7. Thus, a 20 Pd alloy is positioned for example at a level with a satisfactory pink color. It is noted that the addition of a small amount of indium to this 20 Pd alloy has little effect on the color, as illustrated schematically by the positioning of the 20 Pd 10 In alloy in FIG. 7, which is very close to the 20 Pd alloy. As an observation, if we had added 10 Pd to the 20 Pd alloy, in order to obtain a 30 Pd alloy, as a replacement for the 10 In added, the desaturation of the pink color would have been very pronounced. This also makes it possible to conclude that, from the point of view of the color, it is advantageous to combine indium and palladium, rather than to consider a single equivalent amount of palladium. It furthermore appears that, in order to obtain a satisfactory pink color, the sum of the contents of the two components must not be too large, otherwise the pink will be degraded with respect to the desired pink. It is thus preferable to remain at less than or equal to 35‰, or even 33‰, 30‰, 29‰ or 25‰, these values representing various plateaus, which are all satisfactory, but that successively make it possible to improve the result. In addition, it is also advantageous to select a sufficient minimum amount of the sum of the contents of the palladium and indium components in order to prevent the pink color from tending toward red. For this, it appears that a minimum of 15‰ is highly recommended, and that it is necessary to preferably select a value greater than or equal to 20‰, or even 25‰. As a summary of these considerations, the sum of the palladium and indium contents is advantageously within the ranges between 15‰-35‰, or even between 20‰ and 35‰, or even between 25‰ and 33‰, which represent advantageous choices for obtaining a satisfactory pink color of a gold alloy, it being possible for these limits to be included or excluded.

Finally, the rose gold alloys that combine palladium and indium are advantageous since they make it possible simultaneously to achieve a color of satisfactory esthetics and which discolors little with time. The precise amounts for each of these two components and the sum thereof represent compromises between the reduction in discoloration and the esthetics of the desired pink color. We note however that the ranges for this sum of the palladium and indium contents that make it possible simultaneously to achieve a satisfactory pink color and a low discoloration are between 15‰ and 35‰, or even between 20‰ and 35‰, or even between 25‰ and 33‰, as emerges from the preceding analyses. Within these ranges, a high palladium content, greater than or equal to 15‰, or even greater than or equal to 19‰, is favorable to the reduction in discoloration. On the contrary, a low palladium content, less than or equal to 20‰, or even less than or equal to 19‰ or 18‰, is favorable to the esthetics of the pink color. As a compromise, a palladium content between 19‰ and 25‰ inclusive forms a good solution.

The preceding considerations may be adapted to any amount of copper greater than or equal to 180‰, especially also for a relatively small amount of copper, for example between 180‰ and 200‰. However, we note that it is possible to relax some of the above ranges supposing that a large amount of copper is imposed, especially greater than or equal to 200‰. Indeed, in this case, a pink color may be more easily obtained, even using larger amounts of the components palladium and indium that tend to degrade it, as explained above. The result of this is that if the amount of copper Cu is greater than or equal to 200‰, it is possible to obtain suitable alloys with a palladium content between 4‰ and 35‰ and an indium content between 1‰ and 16‰.

Thus, the invention relates to a timepiece or jewelry part comprising an alloy comprising at least 750‰ gold by weight, wherein the alloy also comprises at least 200‰ copper, between 4‰ and 35‰ palladium and between 1‰ and 16‰ indium.

In all cases, if it is desired to guarantee the optimal anti-discoloration effect (anti-aging effect with time), it then becomes advantageous to choose a relatively high palladium content, which may then be between 19‰ and 35‰, or even between 21‰ and 35‰. If it is also desired to avoid too great a degradation of the esthetics of the pink color, it is possible to lower the upper threshold of the palladium content, closer to 30‰ if possible and preferably strictly under 30‰. The optimal ranges taking into account these constraints are then a palladium content between 23‰ and 31‰ inclusive, or even between 23‰ and 29‰ inclusive, or even between 23‰ and 27‰ inclusive, in order to converge around a value of 25‰ which appears to be a good compromise. As an observation, it is noted that, starting from the use of a small amount of indium, for example between 1‰ and 10‰, or between 1‰ and 6‰, and even between 1‰ and 4‰, there is a significant advantageous effect owing to the combination thereof with palladium according to the above contents.

The preceding considerations were made using an example of 18 carat rose gold, i.e. 750‰ gold. As a variant, the results remain relevant for a larger amount of gold, in particular between 750‰ and 800‰, or even 750‰ and 770‰.

The above compositions mention only the predominant elements of the alloy, to which it is possible to add at least one grain refining element according to the knowledge of a person skilled in the art, which gives other embodiment variants of the invention. This grain refining element may be present, for example, at most at a content of 2‰, or even 1‰, of at least one element selected by way of example from Ru, Ir, Re, Co, V and Mo. in particular, the elements such as Ir, Re or Ru make it possible to guarantee the fineness of the grain and to avoid porosities, without substantially modifying the hardness, nor affecting the color, which is advantageous with respect to the desired object.

On the other hand, as was explained above, the alloys could also comprise other components, in addition to the components Au, Cu, Pd and In mentioned to the optional grain refiners, these other components being selected from among Ca, Sr, Si, Ti, Zr, Mg. Advantageously, the sum of the contents of all the elements of the alloy apart from gold and copper is less than or equal to 40‰. As a variant, the alloy may consist of only these four components Au, Cu, Pd, In, with one (or more) optional grain refiner(s).

On the other hand, the various figures illustrate a particular technical effect obtained with the addition of calcium Ca and/or silicon Si, in a very small amount, regarding the reduction in discoloration of the alloys cited by way of example. A very small amount, in particular less than or equal to 10‰, or even 7‰, or even 5‰, for calcium, and/or less than or equal to 2‰, or even 0.5‰, for silicon, is sufficient to significantly reduce the discoloration over time of the alloys illustrated, without having a notable effect on the color itself, provided that a sufficient content of copper, preferably greater than or equal to 180‰, more preferably greater than or equal to 200‰, is used. As an observation, this effect of the components Ca and Si is also borne out on any other rose gold alloy, not necessarily comprising palladium and/or indium.

As an additional observation, it is noted that such a rose gold alloy according to the embodiments of the invention advantageously does not comprise silver, which would induce the negative effect of yellowing the color of the alloy and even of making this color tend toward an unattractive greenish color, then moving away from the desired pink color. Furthermore, as is seen at the bottom of the table from FIG. 3 from a test carried out with an example of a 40 Ag alloy, it appears that silver does not have any very effective effect on the resistance of the color over time, in comparison with the other alloys studied. There are therefore two good reasons for excluding silver from all the embodiments proposed above. However, alloys comprising a small amount of silver are not totally excluded since they could still take up the advantages mentioned above, if they are preponderant over the effect of the silver. Substantially the same conclusion is obtained for manganese. Other tests have furthermore shown that zinc, chromium or iron have no effect on the resistance of the color over time.

Lastly, in all the embodiments above, the alloys described will therefore perform particularly well for producing all or a portion of a timepiece, such as a watch case, a bracelet, a watch, etc., or a jewelry part. Naturally, this creation of a timepiece or jewelry part means the manufacture of all or a significant portion of the thickness of a timepiece, and not a simple surface coating. The tests studied and described above furthermore relate to solid volumes of certain alloys. Thus, the pieces or parts considered comprise a large amount of alloy, are advantageously in the form of a solid alloy capable of being deformed and of being polished, in particular comprising at least one portion having a thickness greater than or equal to 0.1 mm.

The invention claimed is:

1. A timepiece or jewelry part comprising an alloy consisting essentially of, by weight:

at least 750‰ gold, at least 200‰ copper, between 19‰ and 35‰ palladium, between 1‰ and 16‰ indium, optionally, at least one grain refining element selected from the group consisting of ruthenium (Ru), iridium (Ir), rhenium (Re), cobalt (Co), vanadium (V), and molybdenum (Mo), and optionally, at least one element selected from the group consisting of calcium (Ca), strontium (Sr), silicon (Si), titanium (Ti), zirconium (Zr) and magnesium (Mg), wherein the alloy does not have silver, wherein a surface of the timepiece or jewelry part exhibits color stability so that a color difference ΔE in the CIELAB space over 40 days is at most about 1.23.

2. The timepiece or jewelry part as claimed in claim 1, wherein the alloy does not have calcium and does not have silicon.

3. The timepiece or jewelry part as claimed in claim 1, wherein the timepiece or jewelry part has at least one solid portion composed of said alloy and having a thickness greater than or equal to 0.1 mm.

4. The timepiece or jewelry part as claimed in claim 1, wherein a sum of contents of palladium and indium in the alloy is between 20‰ and 35‰ by weight.

5. The timepiece or jewelry part as claimed in claim 1, wherein a content of the at least one grain refining element is more than 0‰ by weight.

6. The timepiece or jewelry part as claimed in claim 1, wherein the alloy is selected from the group consisting of:

alloys consisting of gold, copper, palladium, indium, alloys consisting of gold, copper, palladium, indium and at least one grain refining element selected from the group consisting of Ru, Ir, Re, Co, V and Mo, alloys consisting of gold, copper, palladium, indium, and at least one element selected from Ca, Sr, Si, Ti, Zr, and Mg, and alloys consisting of gold, copper, palladium, indium, at least one grain refining element selected from the group consisting of Ru, Ir, Re, Co, V and Mo, and at least one element selected from Ca, Sr, Si, Ti, Zr, and Mg.

7. The timepiece or jewelry part as claimed in claim 1, wherein a content of the at least one element selected from the group consisting of Ca, Sr, Si, Ti, Zr, and Mg is more than 0‰ by weight.

8. The timepiece or jewelry part as claimed in claim 1, wherein the sum of the contents of all of the elements of the alloy apart from gold and copper is less than or equal to 40‰ by weight.

9. A watch comprising a timepiece as claimed in claim 1.

10. The timepiece or jewelry part as claimed in claim 1, wherein a content of palladium is between 21‰ and 35‰ by weight and a content of indium is between 1‰ and 10‰ by weight.

11. The timepiece or jewelry part as claimed in claim 1, wherein a content of palladium is between 23‰ and 31‰ by weight and a content of indium is between 1‰ and 6‰ by weight.

12. The timepiece or jewelry part as claimed in claim 1, wherein a content of palladium is between 23‰ and 27‰ by weight and a content of indium is between 1‰ and 4‰ by weight.

13. The timepiece or jewelry part as claimed in claim 1, wherein the sum of the contents of palladium and indium in the alloy is more than or equal to 25‰ by weight and less than or equal to 35‰ by weight.

14. The timepiece or jewelry part as claimed in claim 1, wherein the sum of the contents of palladium and indium in the alloy is less than or equal to 30‰ by weight.

15. The timepiece or jewelry part as claimed in claim 1, wherein the sum of the contents of palladium and indium in the alloy is less than or equal to 25‰ by weight.

16. The timepiece or jewelry part as claimed in claim 1, wherein the alloy does not have manganese.

17. The timepiece or jewelry part as claimed in claim 1, wherein the sum of the contents of palladium and indium in the alloy is between 25‰ and 33‰ by weight.

18. The timepiece or jewelry part as claimed in claim 1, wherein the alloy consists of:

the gold, copper, palladium, indium, the at least one grain refining element selected from the group consisting of Ru, Ir, Re, Co, V and Mo, and the at least one element selected from the group consisting of Ca, Sr, Si, Ti, Zr, and Mg.

19. The timepiece or jewelry part as claimed in claim 1, wherein the alloy consists of:

the gold, copper, palladium, indium, and the at least one grain refining element selected from the group consisting of Ru, Ir, Re, Co, V and Mo.

20. The timepiece or jewelry part as claimed in claim 1, wherein the alloy consists of:

the gold, copper, palladium, indium, and the at least one element selected from the group consisting of Ca, Sr, Si, Ti, Zr, and Mg.

21. The timepiece or jewelry part as claimed in claim 5, wherein a content of the grain refining element(s) is more than 0‰ by weight and less than or equal to 2‰ by weight.

22. The timepiece or jewelry part as claimed in claim 5, wherein a content of the grain refining element(s) is less than or equal to 1‰ by weight.

23. The timepiece or jewelry part as claimed in claim 6, wherein the at least one element selected from the group consisting of Ca, Sr, Si, Ti, Zr, and Mg has at least one selected from the group consisting of (i) calcium, wherein a content of calcium is more than 0‰ by weight and less than or equal to 10‰ by weight, and (ii) silicon, wherein a content of silicon is more than 0‰ by weight and less than or equal to 2‰ by weight.

* * * * *